United States Patent [19]

Napadow

[11] Patent Number: 4,946,718

[45] Date of Patent: Aug. 7, 1990

[54] AIR CURTAIN HOUSING FOR CONVEYOR MECHANISM

[75] Inventor: Stanley C. Napadow, Elgin, Ill.

[73] Assignee: Protectaire Systems Co., Elgin, Ill.

[21] Appl. No.: 274,017

[22] Filed: Nov. 21, 1988

Related U.S. Application Data

[63] Continuation of Ser. No. 815,258, Dec. 31, 1985, abandoned.

[51] Int. Cl.[5] ..... B05D 1/02; B05B 15/12

[52] U.S. Cl. ..... 427/424; 118/324; 118/326; 432/64

[58] Field of Search ..... 432/64; 118/326, 324; 427/424

[56] References Cited

U.S. PATENT DOCUMENTS

| | | | |
|---|---|---|---|
| 2,819,889 | 1/1958 | Dany | 432/64 |
| 3,750,622 | 8/1973 | Repp et al. | 118/326 |
| 4,135,906 | 1/1979 | Gladieux et al. | 432/64 |
| 4,207,833 | 6/1980 | Napadow | 118/324 |
| 4,471,688 | 9/1984 | Smets | 98/36 |
| 4,513,682 | 4/1985 | Otocki | 118/326 |

*Primary Examiner*—Shrive Beck

*Attorney, Agent, or Firm*—Fitch, Even, Tabin & Flannery

[57] ABSTRACT

An air curtain conveyor protection system that prevents airborne particles from entering a slot through which the product support members extend from the conveyor mechanism housing into the product treatment booth. A continuous stream or curtain of high velocity air flows across the slot in the conveyor housing, exiting from an outlet or supply nozzle formed by a plenum on one side of the slot and entering into a suction nozzle formed on the opposite side of the slot by a second plenum. A fan or blower is associated with each plenum to force ambient air through the supply nozzle and to draw air through the suction nozzle. Ambient air flowing between the nozzles forms an air curtain across the slot to prevent ingress of the deleterious atmosphere in the product treatment booth into the conveyor housing.

5 Claims, 3 Drawing Sheets

AIR CURTAIN HOUSING FOR CONVEYOR MECHANISM

This is a continuation of application Ser. No. 815,258, filed Dec. 31, 1985, now abandoned.

This invention relates to a device for protecting the mechanism of a conveyor system that carries particles through deleterious atmospheres existing within paint spraying booths, washer or filter air cleaning systems, finish-baking ovens, and other product treatment booths.

In many industrial product-treatment processes, the atmosphere within a product treatment booth through which a conveyor system transports the product is quite corrosive or contaminated and, consequently, is capable of binding up or corroding the support and drive components of the conveyor system within a very short period of time. This can dramatically increase the power required to operate the conveyor and, ultimately, cause a breakdown of the conveyor system, often entailing great expense due to the cost of repairs as well as the loss of production during the time which the conveyor is nonfunctional. Additionally, it is desirable to prevent contamination and marring of the product being treated in the booth due to the dripping of contaminants that may have collected on the conveyor system or by the introduction of other particles or environmental effects from the conveyor system.

Efforts to overcome these problems by maintaining a cleaner atmosphere for the conveyor have resulted in the conveyor system shown in U.S. Pat. No. 4,207,833, having the same assignee as the present invention. In this system, a shrouded conveyor is shielded from the deleterious atmosphere, while the product being treated is protected from conveyor-introduced contaminants, by means of an air curtain directed laterally across a slot in the conveyor housing through which the conveyor hangers extend, along with a flow of clean air flowing downward through the slot from the conveyor housing itself. The air curtain forms a barrier that prevents the ingress of a deleterious atmosphere through the slot toward the conveyor mechanism, while carrying away from the product contaminants that may drip from the conveyor system and otherwise fall through the slot onto the product. The air curtain is then exhausted through the air exhaust for the product treatment booth.

Such a system has proven successful in preventing the migration of deleterious atmospheric fluid into the conveyor housing, thus maintaining the conveyor mechanism generally clean, and in protecting the workpiece from being marred due to drippings from the conveyor, etc. However, such a system introduces large quantities of air into the treatment booth, which pressurizes the booth and introduces additional air which, in many cases, must be washed or filtered prior to being exhausted to the outside atmosphere. This burdens the booth's existing air cleaning systems. Further, because the air curtain introduces ambient temperature air into the booth, e.g., air at 68° F., the use of this air curtain in ovens has required that additional heated air be introduced into the oven to maintain the desired temperature, resulting in higher energy costs. Also, conventional conveyor protection devices for high temperature ovens often are insulated to protect against heat transfer to the conveyor. But even so, the conveyor elements are raised to high temperatures, e.g., 200° F. in their travel through the oven. It is desirable to reduce this temperature substantially to overcome lubrication problems and the dropping of lubricant from the conveyor.

Accordingly, it is an object of the present invention to provide an improved conveyor shrouding structure that keeps deleterious environmental fluids from collecting on and corroding the conveyor mechanism.

It is more particularly an object to provide an air curtain conveyor shrouding structure that is substantially self-contained and does not affect the internal atmosphere of the booth.

These objects as well as others that will become apparent upon reference to the accompanying drawings and following detailed description are provided by means of an air curtain conveyor protection system that prevents airborne particles from entering a slot through which the product support members extend from the conveyor mechanism housing into the product treatment booth. A continuous stream or curtain of high velocity air flows across the slot in the conveyor housing, exiting from an outlet or supply nozzle formed by a plenum on one side of the slot and entering into an suction means or suction nozzle formed on the opposite side of the slot by a second plenum. Fan or blower means are associated with each plenum to force ambient air through the supply nozzle and to draw air through the exhaust nozzle. Thus, the ambient air forming an air screen across the slot will not be discharged into the booth to mix with air in the booth and to cool the same (when the booth is an oven). Further, the booth will not be pressurized.

DETAILED DESCRIPTION OF THE PREFERRED EMBODIMENT

Figure 1:
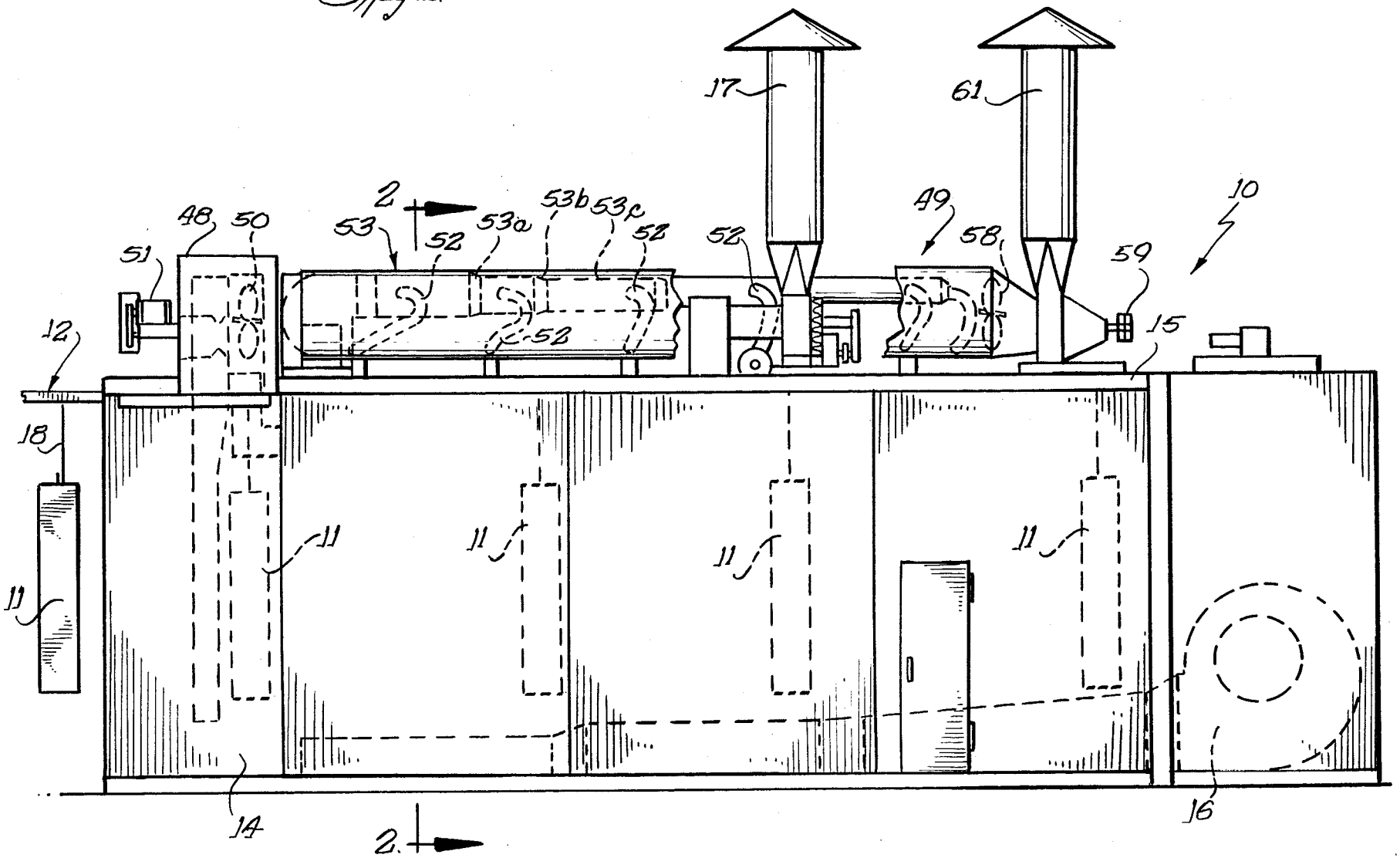
FIG. 1 is a side view of a finish baking oven of a type that may advantageously utilize the inventive conveyor protection system.
Figure 2:
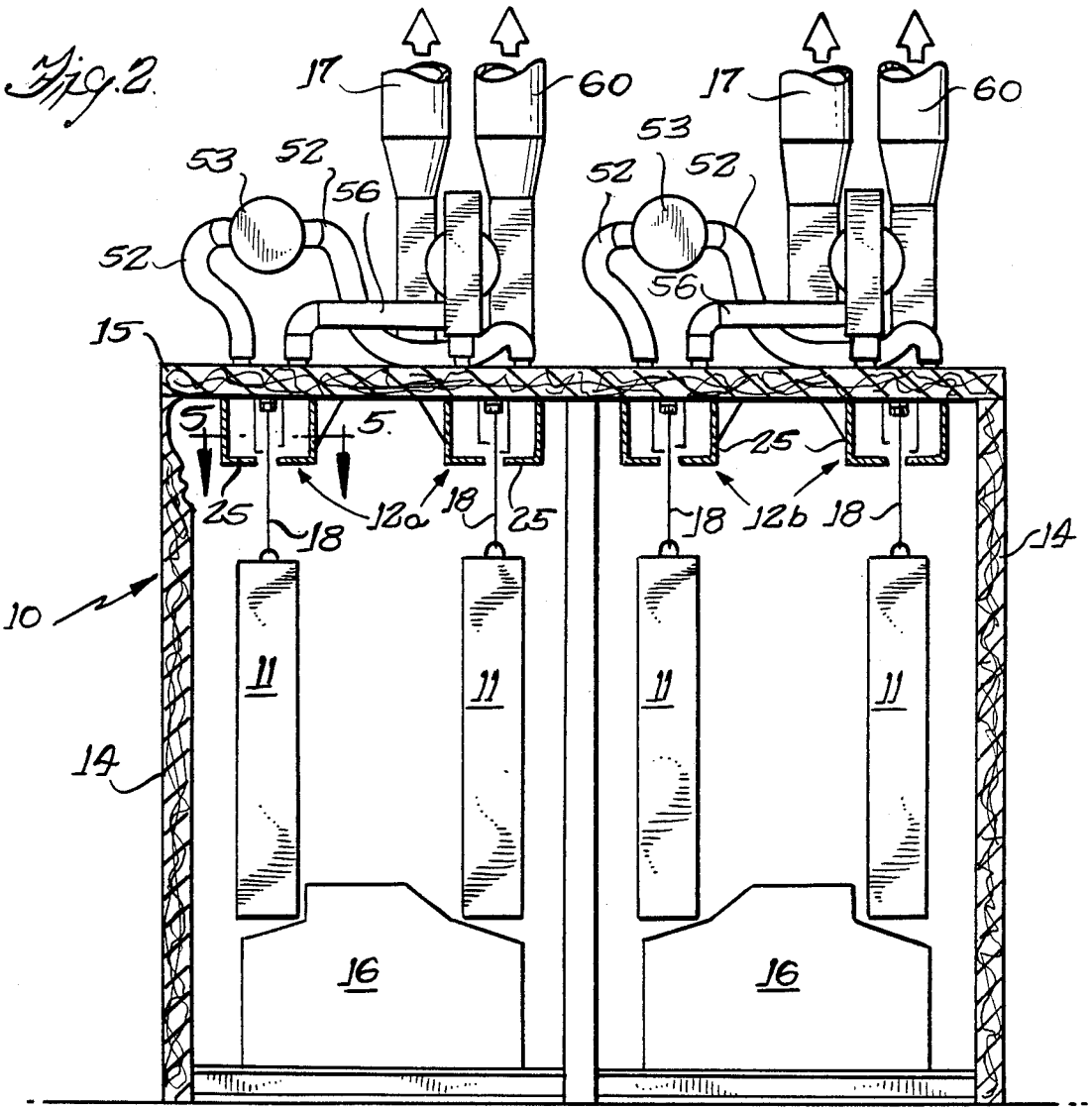
FIG. 2 is an enlarged cross-sectional view of the baking oven taken substantially along lines 2—2 of FIG. 1.
Figure 5:
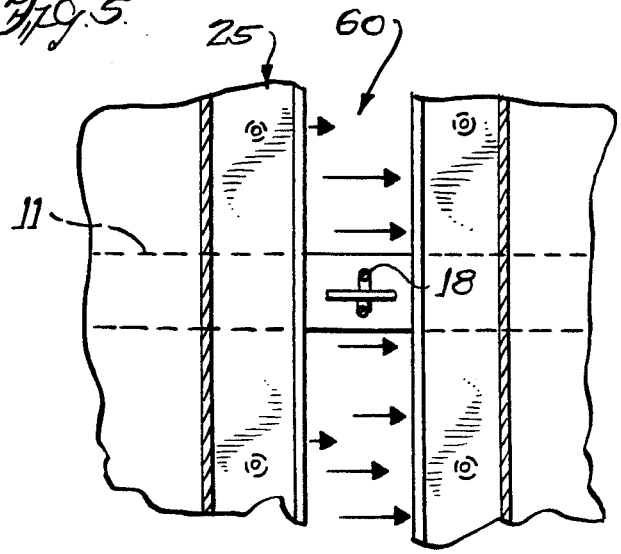
FIG. 5 is an enlarged sectional view of the conveyor protection system taken substantially along line 5—5 of FIG. 2.

As shown in the drawings, the invention is generally used in connection with a protective chamber or booth, indicated by 10, through which articles 11 are transported by a conveyor system 12 in order to treat the articles 11 by, for example, spraying a finish thereon, baking on a finish, etc. Referring to FIGS. 1 and 2, the illustrated booth 10 is a baking oven having insulated vertical side walls 14, top wall 15, and a heating plant 16 and exhaust stacks 17. Typically, the booth 10 provides an enclosed environment that contains an atmosphere which may contain excessive amounts of sprayed liquid, liquid vapor, airborne particles, heat, acidic air, phosphates, etc., which are deleterious to the conveyor system. Usually, an air cleaning system (not shown) is included with the booth 10 to remove the bulk of such deleterious impurities in the air before the air is discharged into the atmosphere ambient the outside of the booth 10.

As best seen in FIG. 2, the baking oven 10 has tandem conveyor systems 12a,b that transport the articles 11 on a U-shaped path through the booth 10 so as to enter and exit the booth 10 at the same end. The conveyor 12 includes hangers 18 extending downwardly therefrom on which the articles 11 are placed in order to be transported through the booth 10. The conveyor system 12 may be of various configurations and, as illustrated, includes an elongated channel or beam support 20 (best seen in FIG. 3) secured to the top wall 15 of the booth 10 with rollers 21 being maintained within the channel 20 for axial movement therealong by means of a flexible chain 22 and drive system (not shown). Typically, the channel 20 and chain 22 are endless, i.e., in the form of a continuous loop, which allows bidirectional movement of the conveyor system 12. As illustrated, the rollers 21 carry hook supports 24 which are secured to certain of the rollers 21 at spaced intervals along the length of the chain 22 for carriage of the hangers 18. Each article 11 to be conveyed through the booth 10 is hung from the lower end of the hanger 18, typically at a distance considerably spaced from the conveyor support channel 20. The space heretofore was preferably on the order of two to two and one-half feet in paint spray booths. This distance heretofore insured that any air flow from the air curtain downward toward the article 11 was dissipated before it could contact the article and mar the finish with particles carried thereby or ripple the paint due to the air velocity.

Within the booth 10, the conveyor components, except for the lower portions of the hangers 18, are located within a housing or shrouding, generally indicated by 25, constructed of a fluid-impervious L-shaped sheet material 26 and generally surrounding the conveyor system except for an elongated continuous slot 28 defined by adjacent longitudinally-extending edges 29, 30 on the lower or bottom walls 31, 32, respectively, of the housing 25. The conveyor hangers 18 extend through the slot 28 to provide the lower, exposed portion on which the articles 11 can be carried. In the illustrated baking oven 10, the outer surfaces of housing 25 support an insulating material 34 in order to protect the components of the conveyor system 12 from the high temperatures in the oven which might otherwise vaporize the lubricants on the conveyor or cause other problems. Despite the insulating material 34, which could be one inch thick sheets, the temperature of the conveyor leaving a high-temperature oven of 900° F. would be about 200° F. Temperatures of this magnitude have an adverse effect on the conveyor lubrication and bearings. At such high temperatures, lubricants degrade or become liquid and drip from the conveyor onto the articles being conveyed. Also, it is preferred to limit this heat transfer so that the insulating material may be eliminated for the lower and medium temperature ovens operating at temperatures below 800° F.

The amount of ambient air exhausted into a large booth such as a washer or paint bake oven from a conventional conveyor protection device is quite large. For example, the air flowing through the slot of the air protection device at ambient temperatures may be ten percent of the air being heated in and recycled in the booth. For a booth having a 12,000 cfm flow therethrough, it is necessary to supply heat in sufficient quantities to raise the 1200 cfm flow at 68° F. to the oven temperature, e.g., 850° F. Also, it will be seen that fans supplying air at 1200 cfm through the slots of conventional conveyor protection devices will soon pressurize the acidic air in the washer. To reduce the air pressure, acidic air must be withdrawn and normalized before discharge. The discharge of acidic air from a washer also results in the loss of steam, heat, phosphates, etc. that are in a typical washer atmosphere.

In accordance with the present invention, the conveyor protection device protects the conveyor by an air curtain discharged across the slot 28 with only a minimal discharge of the air curtain fluid or air flowing into the interior of the booth 10 which would lower the temperature in the booth or pressurize the booth. This is achieved by discharging air from a first nozzle means 45 on one side of the slot and by receiving the discharged air in a suction means or second nozzle means 46 on the other side of the slot which draws the discharged air and pulls the same into an air discharge duct. Thus, there is a push-pull effect across the slot with air being pushed from the air supply nozzle and pulled across the slots and taken off by the pull or suction means 46. Because the ambient air flowing across the slot is removed at the same rate as it is discharged into the slot, there is little spillage of ambient air into the conveyor or into the booth. As will be explained, this air curtain also acts as a barrier to heat transfer from the oven to the conveyor so that the conveyor operates at a lower temperature.

More specifically, and in accordance with the present invention, rising airborne particles from the booth 10 are prevented from entering slot 28 into the protective conveyor housing 25, while any particles dripping from the conveyor system 12 are kept from entering the interior of the booth 10, by means of a continuous stream or curtain of high-velocity air across the slot 28 defined by the edges 29, 30 of the housing 25. The air curtain exits from an outlet nozzle means formed by a plenum on one side of the slot and is received into an inlet nozzle formed by a plenum on the opposite side of the slot. Fan or blower means are associated with the two plenums to force the air into the plenum defining the outlet nozzle and to pull the air through the plenum defining the inlet nozzle. Thus, the flow of air across the slot 28 prevents the deleterious atmosphere within the booth 10 from entering the conveyor housing 25 and damaging the conveyor system 12.

Figure 3:
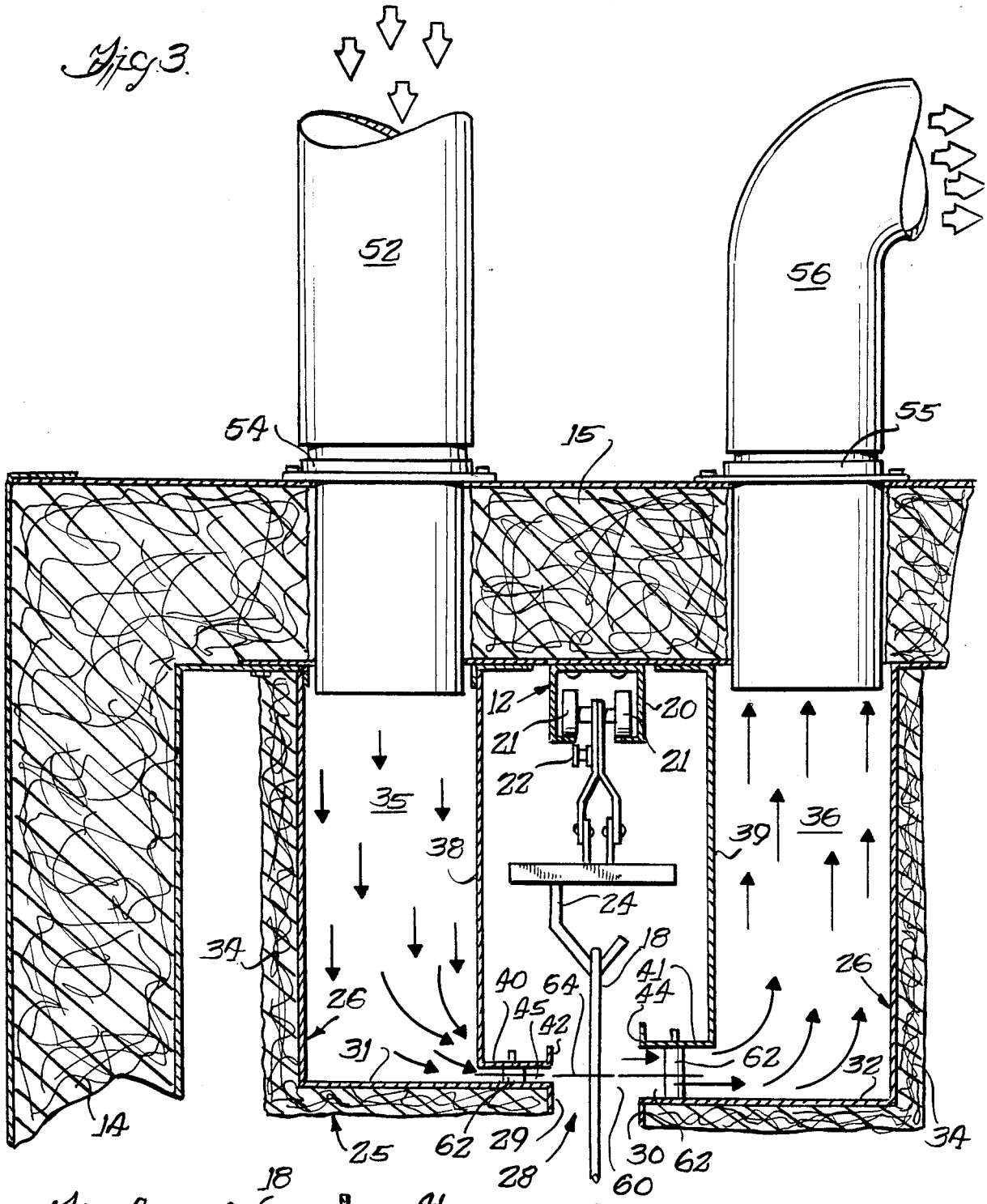
FIG. 3 is a fragmentary portion of FIG. 2 further enlarged to show details of the conveyor protection system.
Figure 4:
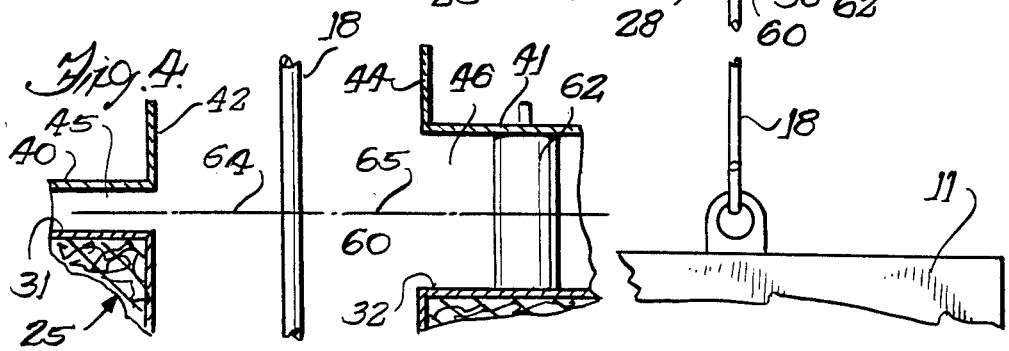
FIG. 4 is a further enlargement of a portion of the conveyor protection system of FIG. 3.

Referring more particularly to FIGS. 3 and 4, plenums 35, 36 are formed interior of the conveyor housing 25 on opposite sides of the slot 28 by means of substantially impermeable L-shaped sheet members 38, 39 respectively. As illustrated, the bottom walls 40, 41 of the sheets 38, 39 are substantially parallel to the bottom walls 31, 32 of the housing 25, with the edges 42, 44 of the bottom walls 40, 41 being substantially perpendicularly aligned with the edges 29, 30 that define the slot 28 in the housing 25. Accordingly, the bottom walls 30, 41 together define an outlet or supply nozzle 45 for the plenum 35, while the bottom walls 31, 42 together define an inlet or exhaust nozzle 46 for the plenum 36.

Connected to each plenum 35, 36 through the top wall 15 of the booth 10 are blower or fan means, generally designated 48, 49. With reference to FIG. 1, blower system 48 supplies air to the outlet plenum 35 by means of a fan 50 powered by motor 51, with the downstream side of the fan 50 operably connected to the plenum 35 at spaced intervals along the length of the conveyor system by means of supply ducts 52 which are secured to duct fittings 54 extending through the top wall 15 into the plenum 35. Extending between the blower means 48 and the individual supply ducts 52 is a common air delivery duct 53 which has sections 53*a*, 53*b* and 53*c* of reduced cross-sectional area in the downstream direction to aid in having each supply duct 52 receive a substantially uniform flow of air. Similarly, blower system 49 exhausts air from the inlet plenum 36 through duct fitting 55 and exhaust ducts 56 by means of fan 58 powered by a motor 59. Downstream of the fan 58 is an exhaust stack 61 through which the air from the conveyor or protection system is exhausted into the ambient atmosphere. Like the supply plenum 35, the exhaust ducts 56 are spaced at intervals along the plenum 36 for the length of the conveyor system.

Accordingly, a substantially-uniform, high-velocity flow between the supply nozzle 45 and the exhaust nozzle 46 forms an air curtain across the slot 48, generally indicated by the arrow 60 in FIGS. 3 and 4. Such an air curtain 60 serves to prevent both the ingress of particles into the conveyor housing 25 and the egress of drippings from the conveyor system 12 through the slot 28 into the booth 10. It has been found that an air curtain having a velocity between about approximately 1,200 to 1,500 feet per minute produces an effective barrier at the slot 2S. In the booth 10 illustrated and described herein, which has approximately 60 feet of conveyor system mechanism in each of the tandem systems 12*a, b*, it has been estimated that for each system supply and exhaust fans 50, 58, having a capacity of 3,000 cubic feet per minute, provide such a velocity. Airborne particulates and other contaminants that are not repelled by the air curtain 60 become entrained therein and are exhausted through the plenum 36 to the conveyor air curtain exhaust stack 61. If the level of the contaminants in the air curtain exhaust dictates, additional filtration or washer units (not shown) can be positioned on the exhaust side of the air curtain system intermediate the plenum 39 and the conveyor exhaust stack 61.

To prevent a major portion of the air flow 60 from spilling from the supply nozzle 45 into the oven 10, the exhaust nozzle 46 is sized to have a larger cross-sectional area than the supply nozzle 45. This ensures that as the wake of the flow 60 expands as it crosses the slot 2B, substantially all the flow 60 is captured by the inlet nozzle 46 of the exhaust plenum 36. In practice, it has been found that satisfactory flow containment is achieved if the distance between the supply plenum walls 31, 40 is on the order of approximately ½ in., the distance between the exhaust plenum walls 32, 41 is between approximately 2 to 4 in., and the width of the slot 28 is between approximately 3 to 8 in. To maintain the proper width for the nozzles 45, 46 spacers 62 are secured to the nozzle walls at predetermined intervals along the length of the conveyor system 12. Spillover of the air curtain 60 is further minimized by substantially aligning the center lines 64, 65 of the supply and exhaust nozzles 45, 46 respectively, as best seen in FIG. 4.

In the illustrated embodiment of the invention, in which the oven booth 10 was operated at about 850° F. but with the use of the conventional conveyor protection device having its walls insulated with one inch of insulation, there was sufficient heat transfer to the conveyor to heat its parts to 200° F. as these parts exited the oven. Such temperatures degrade lubricants and cause lubricants to flow and are detrimental to bearings. With the present invention, there is a marked reduction in heat transfer from the booth to the conveyor with the conveyor parts having a temperature of 140° F. when leaving the 850° F. oven. Another advantage of this low heat transfer is that for lower temperature ovens, e.g., a 350° F. oven, it is possible to dispense with the cost of adding the insulating material 34 to the conveyor housing.

As previously noted, such an air curtain conveyor protection system is particularly advantageous when used in conjunction with finish-baking ovens. It is estimated that for an air curtain of approximately 1,000 cubic feet per minute having an ambient air temperature of approximately 70° F. in an oven having a temperature of approximately 650° F., approximately 47,520 BTUs per hour are saved over a system in which the air curtain spills over completely into the oven and which, consequently, must be heated.

It will be appreciated that the protection device may be used with a variety of conveyor mechanisms different from the illustrated chain and hanger conveyor. For instance, the conveyor may be floor mounted with a conveying pedestal projecting upwardly through a slot to hold the conveyed article above the slot and conveyor, with air being pushed and pulled across the slot. Further, the conveyor protection device can be used in a wide variety of environments and is not limited to the environments of paint spray booths, washers, and ovens herein described.

Accordingly, it can been seen an air curtain conveyor system has been provided that fully meets the objects of the invention. While a preferred embodiment has been shown and described, it will be understood that there is no intent to limit the invention by such disclosure, but, rather, it is intended to cover all modifications and alternate constructions falling within the spirit and scope of the invention as defined in the appended claims.

What is claimed is:

1. A method of conveying articles with a conveyor having a conveyor housing substantially surrounding the conveyor through a booth having a slot connecting an internal chamber within the booth with an interior of the conveyor housing and having process equipment and a treating atmosphere in the booth's internal chamber deleterious to the conveyor, traveling a conveyor through the interior of the enclosed conveyor housing having clean air therein, treating articles within the enclosed internal chamber in the booth and within the deleterious atmosphere, moving a portion of the conveyor projecting through the slot for travel within the slot and extending from the clean air in the conveyor housing interior into the deleterious atmosphere in the enclosed chamber in the booth, blowing air across the slot between the conveyor housing and the enclosed chamber to separate the clean air in the conveyor housing from the deleterious atmosphere, pulling the air flowing across the slot and conveying the pulled air from the booth, preventing clean air from flowing downwardly through the slot from the enclosed conveyor housing into the deleterious atmosphere within the enclosed internal chamber and adversely affecting the treating atmosphere within the enclosed internal chamber, and preventing the upward flow of the deleterious atmosphere from the booth's internal chamber into the enclosed conveyor housing and adversely affecting the conveyor within the conveyor housing.

2. A method in accordance with claim 1 in which the step of treating of articles includes the steps of washing the articles in a washer booth and in which the clear air is prevented from flowing and intermixing washing atmospheres in the washer booth.

3. A method in accordance with claim 1 in which the step of treating of articles includes heating the articles in a curing oven booth with a high temperature atmosphere and in which the clean air is at a lower temperature and is prevented from intermixing with the higher temperature deleterious atmosphere in the curing oven booth.

4. A method in accordance with claim 1 in which the step of treating articles includes a paint spray booth and in which the clear air is prevented from interfering with a paint spraying operation within the internal chamber of the paint spray booth.

5. A booth for treating articles with a treating atmosphere deleterious to a conveyor carrying the articles through the booth, said apparatus comprising:

an enclosed booth having an article treating means within an internal chamber and having the treating atmosphere deleterious to a conveyor, a conveyor having an upper portion and a lower portion for traveling along a predetermined path through a booth and for carrying articles through the internal chamber of the booth, a conveyor housing substantially surrounding the upper portion of the conveyor and having an interior with clean air therein, means defining a slot interconnecting the internal chamber of the booth with the interior of the conveyor housing and through which slot projects the lower portion of the conveyor, a conveyor housing being closed to the ambient atmosphere to prevent escapes of the deleterious atmosphere to the ambient atmosphere, means for blowing clean air across the slot and means for pulling clean air across the slot and preventing clean air from flowing downwardly through the slot from the enclosed conveyor housing into the deleterious treating atmosphere and adversely affecting the treating atmosphere and preventing the upward flow of deleterious atmosphere from the booth internal chamber into the conveyor portion in the enclosed conveyor housing.

* * * * *

UNITED STATES PATENT AND TRADEMARK OFFICE

CERTIFICATE OF CORRECTION

PATENT NO. : 4,946,718

DATED : August 7, 1990

INVENTOR(S) : Stanley C. Napadow

It is certified that error appears in the above-identified patent and that said Letters Patent is hereby corrected as shown below:

Column 1, Line 8, change "particles" to --articles--.

Column 2, Line 22, change "an" to --a--.

Column 5, Line 23, change "2S" to --28--.

Column 5, Line 43, change "2B" to --28--.

Column 7, Line 3, change "clear" to --clean--.

Column 7, Line 15, change "clear" to --clean--.

Column 8, Line 12, change "a" to --said--.

Column 8, Line 13, change "escapes" to --escape--.

Signed and Sealed this

Twenty-fourth Day of December, 1991

*Attest:*

HARRY F. MANBECK, JR.

*Attesting Officer*

*Commissioner of Patents and Trademarks*